US011207673B2

(12) United States Patent
Döbele

(10) Patent No.: US 11,207,673 B2
(45) Date of Patent: Dec. 28, 2021

(54) FLUID-RELEASE UNIT AND MANUAL METERING DEVICE WITH AT LEAST ONE FLUID-RELEASE UNIT

(71) Applicant: IKA-Werke GmbH & Co. KG, Staufen (DE)

(72) Inventor: Philip Döbele, Freiburg (DE)

(73) Assignee: IKA-Werke GmbH & Co. KG, Staufen (DE)

( * ) Notice: Subject to any disclaimer, the term of this patent is extended or adjusted under 35 U.S.C. 154(b) by 226 days.

(21) Appl. No.: 16/349,392

(22) PCT Filed: Oct. 5, 2017

(86) PCT No.: PCT/EP2017/001176
§ 371 (c)(1),
(2) Date: May 13, 2019

(87) PCT Pub. No.: WO2018/086722
PCT Pub. Date: May 17, 2018

(65) Prior Publication Data

US 2019/0262822 A1 Aug. 29, 2019

(30) Foreign Application Priority Data

Nov. 14, 2016 (DE) ..... 10 2016 121 816.2

(51) Int. Cl.
*B01L 3/02* (2006.01)

(52) U.S. Cl.
CPC ..... *B01L 3/0217* (2013.01); *B01L 3/021* (2013.01); *B01L 2200/028* (2013.01);
(Continued)

(58) Field of Classification Search
None
See application file for complete search history.

(56) References Cited

U.S. PATENT DOCUMENTS 4,154,108 A 5/1979 Hirschmann
8,011,257 B2 9/2011 Kneucker et al.
(Continued)

FOREIGN PATENT DOCUMENTS

DE 820332 C 11/1951
DE 102007006076 A1 8/2008
(Continued)

OTHER PUBLICATIONS

International Search Report from PCT Application No. PCT/EP2017/001176, dated Nov. 24, 2017.

*Primary Examiner* — Matthew D Krcha
*Assistant Examiner* — Brittany I Fisher
(74) *Attorney, Agent, or Firm* — Budzyn IP Law, LLC

(57) ABSTRACT

In order to facilitate disassembly of the fluid dispensing unit (4), the latter has the covering cap (17) with which at least one sealing means (18) located in the head part (12) of the fluid dispensing unit (4) can be fixed in its use position. In order to release the covering cap (17) from the head part (12), said covering cap is rotatable relative to the head part (12). A releasable snap connection (19) is provided between the covering cap (17) and the head part (12), said snap connection being formed by at least one latching projection (20) and/or at least one latching depression (21), wherein at least one oblique surface (22) is formed on the latching projection (20) and/or on the latching depression (21), said surface being oriented in such a manner that the snap connection (19) can be released by rotation of the covering cap (17) relative to the head part (12) (FIG. 3).

22 Claims, 3 Drawing Sheets

(52) U.S. Cl.
CPC ... *B01L 2200/087* (2013.01); *B01L 2300/041* (2013.01); *B01L 2300/042* (2013.01)

(56) References Cited

U.S. PATENT DOCUMENTS

| | | | | |
|---|---|---|---|---|
| 8,728,408 | B2 | 5/2014 | Strzelczyk | |
| 2005/0118069 | A1* | 6/2005 | Solotareff | B01L 3/0217 422/400 |
| 2005/0155439 | A1 | 7/2005 | Belgardt | |
| 2010/0083775 | A1* | 4/2010 | Wilmer | B01L 3/0224 73/864.18 |
| 2012/0039768 | A1* | 2/2012 | Strzelczyk | B01L 3/0217 422/501 |
| 2015/0037227 | A1 | 2/2015 | Ding | |
| 2016/0051978 | A1* | 2/2016 | Voyeux | B01L 3/022 422/522 |

FOREIGN PATENT DOCUMENTS

| | | | |
|---|---|---|---|
| DE | 102008048620 | A1 | 3/2010 |
| EP | 2280779 | B1 | 2/2011 |

* cited by examiner

FLUID-RELEASE UNIT AND MANUAL METERING DEVICE WITH AT LEAST ONE FLUID-RELEASE UNIT

FIELD OF THE INVENTION

The invention relates to a fluid dispensing unit for a manual metering device, in particular for a pipette, with a receiving space in which a shifting means can be displaced in order to pick up or to dispense a fluid, in particular a liquid, with the fluid dispensing unit, with a stem and with a head part, wherein the receiving space is connected via a dispensing channel formed in the stem to a dispensing opening formed at a free end of the stem, wherein the head part is arranged at a head end of the fluid dispensing unit, said head end lying opposite the free end of the stem, and wherein the head part has a covering cap which can be removed from the head part and with which at least one element of the fluid dispensing unit, said element being arranged in the head part, can be covered or is covered.

The invention furthermore relates to a manual metering device, in particular a pipette, with a main body and with at least one fluid dispensing unit, wherein the main body comprises shifting means for picking up and dispensing a fluid, in particular a liquid, with the fluid dispensing unit and actuating means for actuating the shifting means, and wherein the main body and the at least one fluid dispensing unit are connected releasably to each other.

BACKGROUND OF THE INVENTION

Such fluid dispensing units and manual metering devices are already known in various forms in the prior art.

During the use of such manual metering devices, it is desirable to be able to remove the fluid dispensing unit from a main body of the manual metering device, for example for cleaning or else for carrying out repairs.

In order to be able to exchange elements of the fluid dispensing unit when required or to be able to subject same to thorough cleaning, the fluid dispensing unit can also be disassembled at least into parts. In particular elements which are arranged in the head part of such a fluid dispensing unit can be covered with the aid of the covering cap in its use position on or in the head part and can thus be protected against soiling or damage.

In particular, the frequently small individual parts of the fluid dispensing unit can easily fall apart and become lost after the fluid dispensing unit is detached from the main body of the manual metering device. This is prevented in some manual metering devices and fluid dispensing units already known from the prior art by means of the previously mentioned covering cap. A connection between the covering cap and the head part of the fluid dispensing unit can be released here only with a certain effort, sometimes only with the use of special tools.

SUMMARY OF THE INVENTION

It is the object of the invention to provide a fluid dispensing unit and a manual metering device of the type mentioned at the beginning, which simplify disassembly of the fluid dispensing unit, for example for the repair or cleaning thereof.

According to the invention, this object is achieved in the case of a fluid dispensing unit of the type mentioned at the beginning by the means and features of claim 1. To achieve the object, in particular in the case of a fluid dispensing unit of the type mentioned at the beginning, it is proposed that the covering cap is fastened to the head part by means of a releasable snap connection, wherein at least one latching projection and/or at least one latching depression of the snap connection has at least one oblique surface which is oriented in such a manner that the snap connection can be released by rotation of the covering cap relative to the head part.

It can be advantageous here if the covering cap in its use position fixed to the head part can be rotated relative to the head part in order to release the snap connection.

A fluid dispensing unit is thereby provided, the covering cap of which firstly is fastened reliably to the head part of the fluid dispensing unit and the covering cap of which secondly can be removed easily from the head part without great effort and above all without the use of a disassembly aid, in order to dismantle or to open the fluid dispensing unit, for example for cleaning and/or repair and/or exchange of individual parts of the fluid dispensing unit, said individual parts being arranged in the head part.

In one embodiment of the fluid dispensing unit according to the invention, it can be provided that the fluid dispensing unit has a sealing means which is arranged in the head part. In this connection, it can be particularly advantageous if the sealing means can be fixed or is fixed with the covering cap in its use position in the head part. The covering cap can thereby have a dual function. Firstly, it can prevent the elements of the fluid dispensing unit that are arranged in the head part from being lost or soiled. Secondly, it can ensure that the sealing means remains positioned in its correct sealing position.

In an embodiment according to the invention of the fluid dispensing unit, it can be provided that the at least one latching projection is arranged on the covering cap and the at least one latching depression is arranged on the head part. In another embodiment of the fluid dispensing unit according to the invention, it can be provided that the at least one latching depression is arranged on the covering cap and the at least one latching projection is arranged on the head part.

In a preferred embodiment of the fluid dispensing unit, the at least one latching projection in each case has an oblique surface on two opposite sides oriented transversely with respect to the direction of rotation of the covering cap. As an alternative or in addition thereto, in a further embodiment of the invention, the at least one latching depression can in each case have an oblique surface on two opposite sides oriented transversely with respect to the direction of rotation of the covering cap.

In particular if each latching depression and each latching projection in each case has one such oblique surface on two opposite sides oriented transversely with respect to the direction of rotation of the covering cap, the latching connection between the covering cap and the head part of the fluid dispensing unit can easily be released by rotation of the covering cap relative to the head part in both conceivable direction of rotation.

It is possible here that the at least one oblique surface is formed by a bevel on a side of the latching projection or of the latching depression, which side is oriented transversely or at right angles with respect to the direction of rotation of the covering cap.

The fluid dispensing unit can be designed as a piston unit, in which the receiving space is a cylinder into which a piston of a manual metering device can be pushed in order to discharge a fluid arranged in the cylinder. By the piston being pushed into the cylinder, the fluid located therein can be pushed out of the cylinder. In one embodiment of the fluid dispensing unit, it can be provided that said fluid dispensing unit, in the form of a piston unit, itself has a piston as at least one shifting means, said piston being displaceable in the receiving space. The piston can then be displaced within the receiving space with further shifting means, for example a manual metering device.

The covering cap can have a passage opening. Through said passage opening, for example, a piston and/or a piston rod of a manual metering device, in particular a pipette, can be introduced into the receiving space.

The sealing means can be a sealing ring. In particular when the fluid dispensing unit according to the invention is used in a manual metering device which has a piston, the sealing ring can also be a piston sealing ring with which a gap between a piston which can be introduced into the receiving space, in particular into the cylinder, and the cylinder can be sealed.

In order to be able to fix the sealing means in a use position in the head part of the fluid dispensing unit, the sealing means can be pressurized. In order to pressurize the sealing means, a compression spring and/or a pressure piece can be arranged between the covering cap and the sealing means. When a compression spring and a pressure piece are used between the covering cap and the sealing means, it can be expedient if the pressure piece lies against the sealing means. In this manner, when the covering cap is fixed to the head part, first of all the compression spring can be pretensioned, as a result of which the latter can then press the pressure piece preferably axially against the sealing means. Reliable sealing can thereby take place.

The fluid dispensing unit according to the invention can obtain a particularly compact configuration if the covering cap can be inserted or is inserted into the head part. In the case of a covering cap which can be inserted into the head part, it can be advantageous if the at least one latching means, i.e. the at least one latching projection or the at least one latching depression, are arranged on an outer circumference of the covering cap. In a manner corresponding thereto, the latching depression completing the latching connection and/or the latching projection completing the latching connection can then be arranged or formed at a corresponding point of an inner circumference in a receptacle of the head part for the covering cap.

In order to be able to insert the covering cap into the head part, the head part can have a receptacle for the covering cap and the covering cap can be insertable or inserted into the receptacle of the head part.

The fluid dispensing unit can further comprise at least one fastening means for releasably fastening the fluid dispensing unit to a main body of a manual metering device. Said fastening means can be a thread, in particular an external thread, preferably formed on the head part.

In order to facilitate release of the covering cap from the head part, the covering cap can have a gripping region. Said gripping region, in the use position of the covering cap on the head part, can protrude over the head part such that it is particularly easily accessible for a user of the fluid dispensing unit. The region here can be roughened, knurled and/or can have an anti-slip coating in order to make a rotatable release of the covering cap from the head part even easier.

The object is also achieved by a manual metering device with the means and features of the independent claim which is focused on the manual metering device. In particular, in order to achieve the object, a manual metering device of the type mentioned at the beginning is therefore proposed, in which the at least one fluid dispensing unit is a fluid dispensing unit according to the invention.

The main body and the fluid dispensing unit can be connectable or connected releasably to each other here by means of a screw connection. The fluid dispensing unit can thereby be removed from the main body particularly easily. In this connection, it should be pointed out that there can also be a combined snap/screw connection between the main body and the fluid dispensing unit. In the case of such a snap/screw connection, it can be provided that, when a defined screwing-in depth is reached, a latching connection engages or is produced which provides the user of the manual metering device with a haptic and optionally also acoustic feedback about the correct production of the connection between the main body of the manual metering device and the fluid dispensing unit. This feedback is produced by the connection being correctly produced.

The manual metering device can have, as the shifting means, at least one piston which can be pushed into a receiving space for a fluid with the aid of the actuating means, and a piston rod which is connected to the actuating means and to the piston. In another embodiment of the manual metering device, the latter, as the shifting means, can have a piston rod which is connected to the actuating means and to a piston of the fluid dispensing unit.

BRIEF DESCRIPTION OF THE DRAWINGS

An exemplary embodiment of the invention is described in more detail below with reference to the figures, in which, in a partially highly schematized illustration.

DETAILED DESCRIPTION OF THE INVENTION

Figure 1:
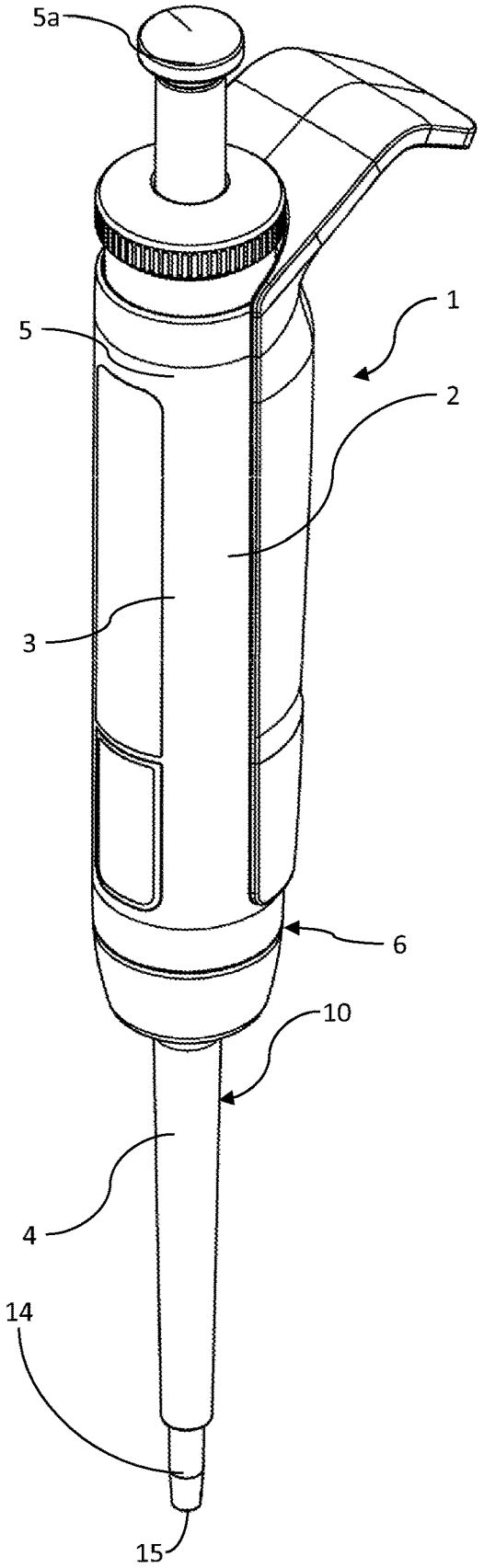
FIG. 1 shows a perspective view of a manual metering device according to the invention designed as a pipette.

FIGS. 1 to 6 show various views of a manual metering device which is denoted as a whole by 1. The manual metering device illustrated in the figures is designed as a mechanical and manually actuable pipette 2. The manual metering device 1 has a main body 3 and a fluid dispensing unit 4.

The main body 3 comprises at least one shifting means 5 with which a fluid, in particular a liquid, can be dispensed and picked up with the fluid dispensing unit 4. In addition, the main body 3 has an actuating means 5*a* in the form of a pusher for actuating the shifting means 5.

The main body 3 and the fluid dispensing unit 4 are releasably connected to each other by means of a screw connection 6.

Figure 2:
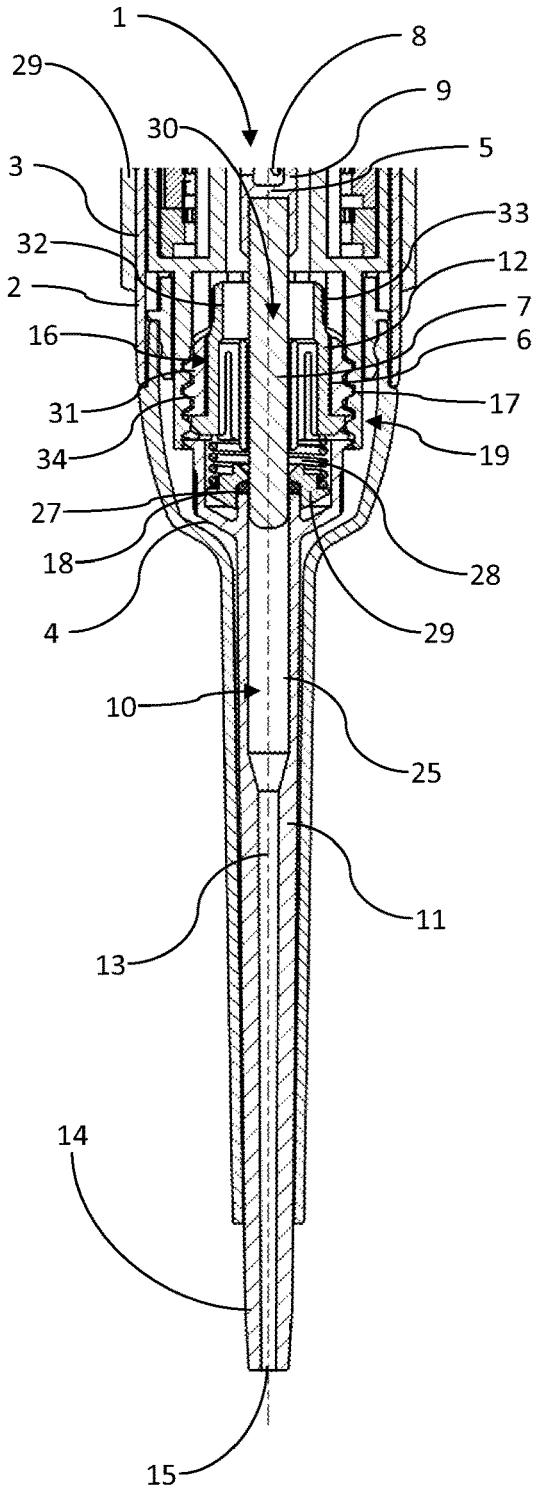
FIG. 2 shows a broken-open sectional illustration of the manual metering device illustrated in FIG. 1.
Figure 3:
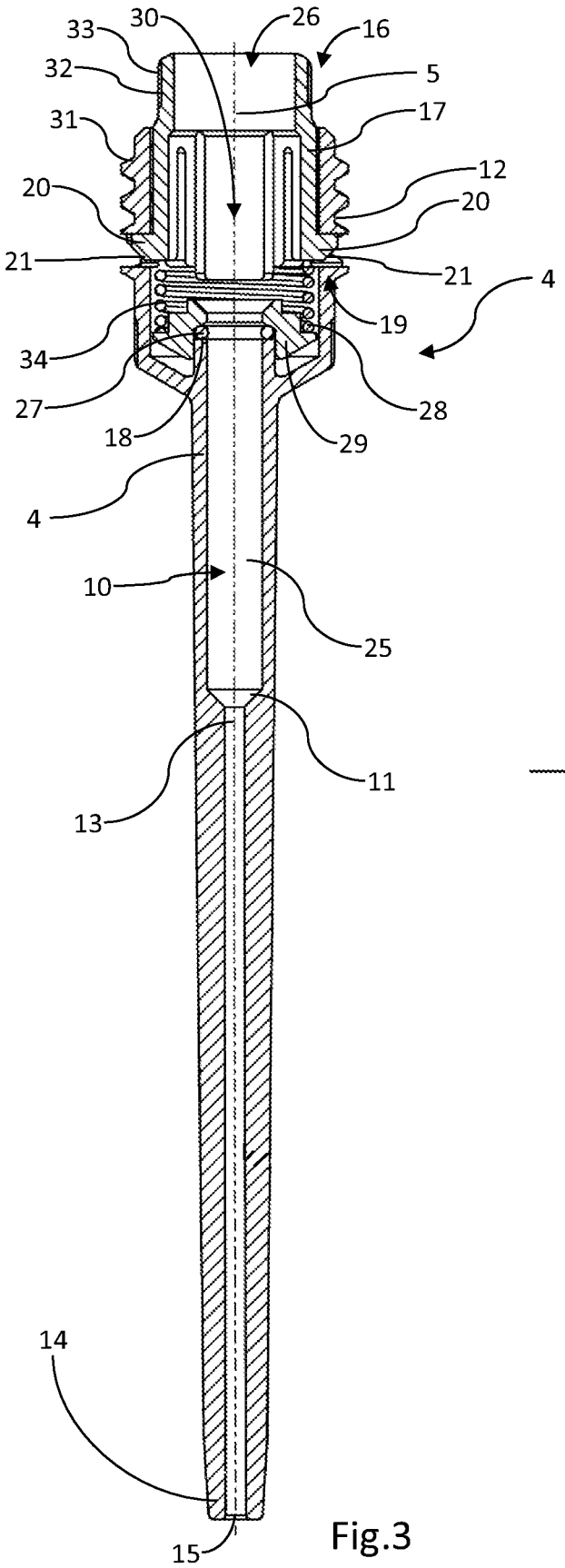
FIG. 3 shows a sectioned side view of the fluid dispensing unit, illustrated in FIGS. 1 and 2, of the manual metering device according to the invention.

The shifting means 5 comprises a piston rod 8 which is connected to a piston 7 of the fluid dispensing unit 4 and can be seen to some extent in FIG. 2. The piston 7 and piston rod 8 are connected to each other via a connecting piece 9.

The fluid dispensing unit 4 comprises a receiving space 10 for receiving an air cushion, a stem 11 and a head part 12.

The receiving space 10 is connected via a dispensing channel 13 formed in the stem 11 to a dispensing opening 15 formed at a free end 14 of the stem 11. The head part 12 is arranged at a head end 16 of the fluid dispensing unit 4, said head end lying opposite the free end 14 of the stem 11. The head part 12 has a covering cap 17 which is removable from the head part 12 and with which at least one sealing means 18 which is arranged in the head part 12 can be fixed in its use position.

The covering cap 17 in its use position on the head part 12 is rotatable relative to the latter and is fastened to the head part 12 by means of a releasable snap connection 19. At least one latching projection 20 and/or at least one latching depression 21 of the snap connection 19 has at least one oblique surface 22 which is oriented in such a manner that the snap connection 19 can be released by rotation of the covering cap 17.

In the exemplary embodiment, illustrated in the figures, of the fluid dispensing unit 4 according to the invention, two such latching projections 20 are formed on the covering cap 17. In a manner corresponding thereto, the head part 2 has latching depressions 21.

Figure 4:
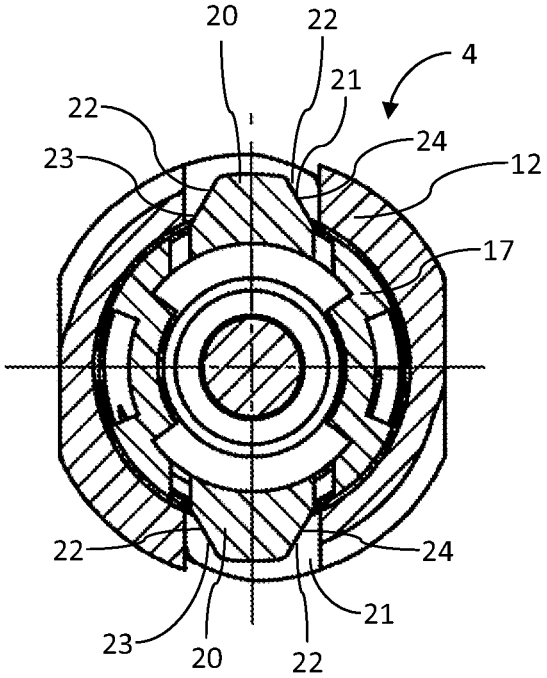
FIG. 4 shows a cross section of the head part of the fluid dispensing unit depicted in FIGS. 1 to 3.
Figure 5:
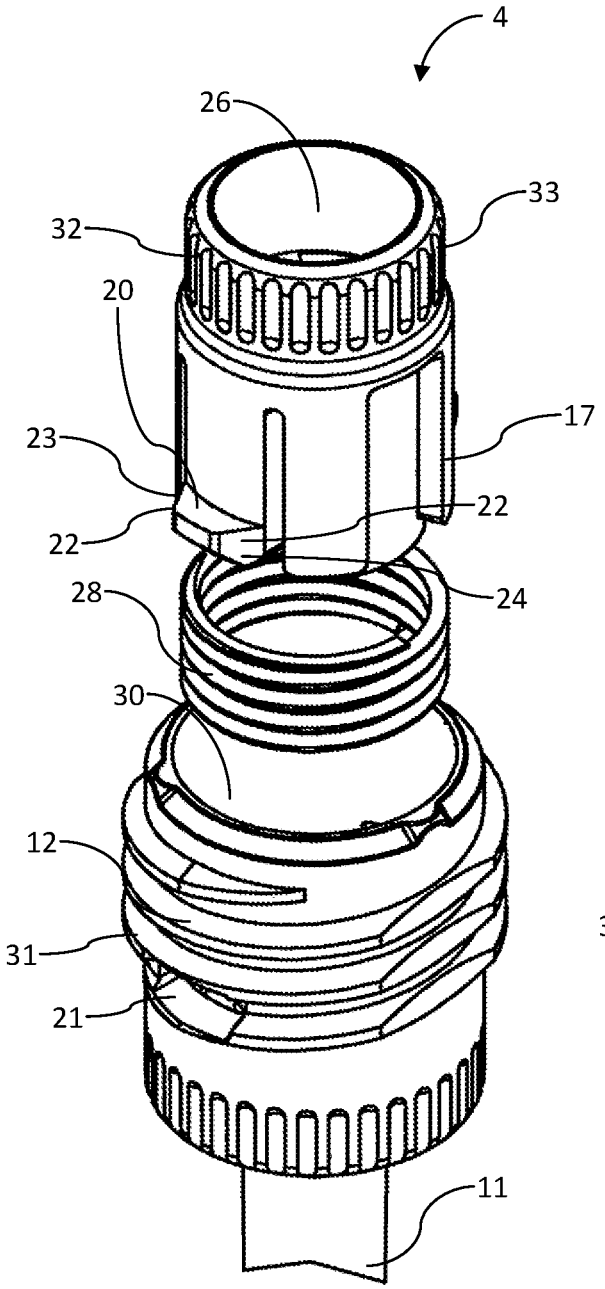
FIG. 5 shows an exploded illustration of the head part of the fluid dispensing unit illustrated in FIGS. 1 to 4.
Figure 6:
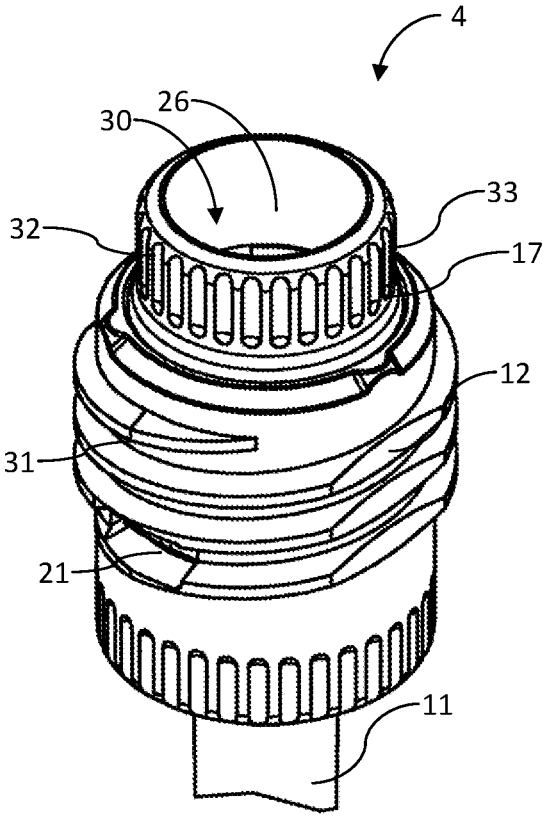
FIG. 6 shows a perspective illustration of the head part of the fluid dispensing unit, which is depicted in the previous figures, in the mounted state.

As in particular the sectional illustration of the head part 12 according to FIG. 4 clarifies, two such oblique surfaces 22 are in each case formed on each of the two latching projections 20 of the head part 12. The two oblique surfaces 22 are formed on two opposite sides 23 and 24 of each of the two latching projections 20, said sides being oriented transversely with respect to the direction of rotation of the covering cap 17.

The two oblique surfaces 22 of each of the two latching projections 20 are in each case formed by a bevel on the sides 23 and 24 of the respective latching projection, which sides are oriented transversely or at right angles with respect to the direction of rotation of the covering cap 17.

The fluid dispensing unit 4 is designed as a piston unit. The receiving space 10 of said piston unit 4 includes a cylinder portion 25.

The covering cap 17 has an upper-side passage opening 26. Through said passage opening 26, the piston 7 and/or the piston rod 8 can be introduced into the receiving space 10, which includes a cylinder portion 25, of the fluid dispensing unit 4 for displacing an air cushion located there in the direction of the dispensing opening 15, which is connected to the cylinder portion 25 via the dispensing channel 13. The displacement of the air cushion in the direction of the dispensing opening 15 is used to discharge a volume, kept in a pipette tip, of liquid to be dispensed out of the pipette tip. In the use position, the pipette tip is plugged onto the free end 14 of the stem 11 and is then in a pressure connection with the dispensing opening 15 and with the dispensing channel 13. A shifting of the air cushion in the direction of the dispensing opening 15 can thus be used for dispensing liquid out of the pipette tip and a shifting of the air cushion into the receiving space 10 can thus be used for picking up liquid into the pipette tip.

The sealing means 18 of the fluid dispensing unit 4 is a sealing ring 27 which can also be referred to as a piston sealing ring 27 since it seals a gap between a wall of the receiving space 10 and the piston 7. This takes place at least whenever the piston 7 is introduced into the receiving space 10.

In order to pressurize the sealing ring 18, which is present as a sealing ring 27, between the covering cap 17 and the sealing means 18, the fluid dispensing unit 4 has a compression spring 28 and a pressure piece 29. When the covering cap 17 is in the use position, the pressure piece 29 is pressed against the sealing means 18 by the pretensioning of the compression spring 28, and therefore said sealing ring can be placed against the surfaces to be sealed from one another. In addition, the sealing means 18 can thus be reliably fixed in its use position in the head part 12 of the fluid dispensing unit 4.

The head part 12 has a receptacle 30 for the covering cap 17. The covering cap 17 can therefore be inserted in the use position into the receptacle 30 of the head part 12, as can be seen clearly, for example, in FIGS. 3 and 6.

As the fastening means for the releasable fastening of the fluid dispensing unit 4 to the main body 3 of the manual metering device 1, the fluid dispensing unit 4 has a thread 31 which is configured as an external thread. The external thread 31 is formed here on an outer side of the head part 12. In addition, the covering cap 17 comprises a gripping region 32 which, in the use position of the covering cap 17 on the head part 12, protrudes over the head part 12. The gripping region 32 is provided with a knurling 33, i.e. is of knurled design.

The main body 3 of the manual metering device 1 has a mating thread 34 in the form of an internal thread which matches the thread 31, which is configured as an external thread, of the head part 12.

In order to facilitate disassembly of the fluid dispensing unit 4, the latter has the covering cap 17 with which at least one sealing means 18 located in the head part 12 of the fluid dispensing unit 4 can be fixed in its use position. In order to release the covering cap 17 from the head part 12, said covering cap is rotatable relative to the head part 12. The releasable snap connection 19 is provided between the covering cap 17 and the head part 12, said snap connection being formed by at least one latching projection 20 and/or at least one latching depression 21, wherein at least one oblique surface 22 is formed on the latching projection 20 and/or on the latching depression 21, said surface being oriented in such a manner that the snap connection 19 can be released by rotation of the covering cap 17 relative to the head part 12.

What is claimed is:

1. A fluid dispensing unit (4) for a manual metering device (1), in particular for a pipette (2), the fluid dispensing unit (4) comprising: a stem (11), a head part (12), and, a receiving space (10), wherein the receiving space (10) is connected via a dispensing channel (13) formed in the stem (11) to a dispensing opening (15) formed at a free end (14) of the stem (11), wherein the head part (12) is arranged at a head end (16) of the fluid dispensing unit (4), said head end lying opposite the free end (14) of the stem (11), wherein the head part (12) has a covering cap (17) removably fastened to the head part (12) by means of a releasable snap connection (19) and with which at least one element of the fluid dispensing unit (4) is selectively covered with the covering cap (17) being fastened to the head part (12), the releasable snap connection (19) including at least one latching projection (20) and at least one latching depression (21) and, wherein at least one of the at least one latching projection (20) and the at least one latching depression (21) has at least one oblique surface (22) which is oriented in such a manner that the releasable snap connection (19) is released by rotation of the covering cap (17) relative to the head part (12).

2. The fluid dispensing unit (4) as claimed in claim 1, wherein the fluid dispensing unit (4) has a sealing means (18) which is arranged in the head part (12), the sealing means (18) being fixed with the covering cap (17) fastened to the head part (12).

3. The fluid dispensing unit (4) as claimed in claim 2, wherein the sealing means (18) is a sealing ring (27).

4. The fluid dispensing unit (4) as claimed in claim 3, wherein the sealing ring is a piston sealing ring.

5. The fluid dispensing unit (4) as claimed in claim 2, wherein, in order to pressurize the sealing means (18), a compression spring (28) is arranged between the covering cap (17) and the sealing means (18).

6. The fluid dispensing unit (4) as claimed in claim 1, wherein the at least one latching projection (20) is arranged on the covering cap (17) and the at least one latching depression (21) is arranged on the head part (12).

7. The fluid dispensing unit (4) as claimed in claim 1, wherein the at least one oblique surface (22) is arranged on the at least one latching projection (20).

8. The fluid dispensing unit (4) as claimed in claim 1, wherein the at least one oblique surface (22) is formed by a bevel on a side (23, 24) of at least one of the at least one latching projection (20) and the at least one latching depression (21), which is oriented transversely with respect to the direction of rotation of the covering cap (17).

9. The fluid dispensing unit (4) as claimed in claim 1, wherein the fluid dispensing unit (4) is a piston unit including a piston (7), and the receiving space (10) includes a cylinder portion (25).

10. The fluid dispensing unit (4) as claimed in claim 1, wherein the covering cap (17) has a passage opening (26) through which a piston (7) can be introduced into the receiving space (10).

11. The fluid dispensing unit (4) as claimed in claim 1, wherein the head part (12) has a receptacle (30) for the covering cap (17), the covering cap (17) being insertable into the receptacle (30) of the head part (12).

12. The fluid dispensing unit (4) as claimed in claim 1, wherein the fluid dispensing unit (4) further comprises at least one fastening means (31) for releasably fastening the fluid dispensing unit (4) to a main body (3) of a manual metering device (1).

13. The fluid dispensing unit (4) as claimed in claim 12, wherein the at least one fastening means (31) is a thread formed on the head part (12).

14. The fluid dispensing unit (4) as claimed in claim 1, wherein the covering cap (17) has a gripping region (32) which, with the covering cap (17) fastened to the head part (12), protrudes over the head part (12).

15. The fluid dispensing unit (4) as claimed in claim 14, wherein the gripping region (32) is one or more of a roughened surface, a knurled surface, and a surface with anti-slip coating.

16. A manual metering device (1), in particular pipette (2), with a main body (3) and with at least one fluid dispensing unit (4) as set forth in claim 1, wherein the main body (3) comprises shifting means (5) for dispensing and picking up a fluid with the at least one fluid dispensing unit (4) and actuating means (6) for actuating the shifting means (5), and wherein the main body (3) and the at least one fluid dispensing unit (4) are releasably connected to each other.

17. The manual metering device (1) as claimed in claim 16, wherein the main body (3) and the fluid dispensing unit (4) are releasably connected to each other by means of a screw connection (6).

18. The manual metering device (1) as claimed in claim 16, wherein the shifting means (5) includes at least one piston (7) which can be pushed into the receiving space (10) with the aid of the actuating means (**5*a***).

19. The fluid dispensing unit (4) as claimed in claim 1, wherein the at least one latching depression (21) is arranged on the covering cap (17) and the at least one latching projection (20) is arranged on the head part (12).

20. The fluid dispensing unit (4) as claimed in claim 1, wherein at least one of the at least one latching projection (20) and the at least one latching depression (21) has the at least one oblique surface (22) on two opposite sides thereof oriented transversely with respect to the direction of rotation of the covering cap (17).

21. The metering device (1) as claimed in claim 16, wherein the main body (3) and the fluid dispensing unit (4) are releasably connected by a combined snap/screw connection.

22. The metering device (1) as claimed in claim 16, wherein at least one of haptic feedback and acoustic feedback is generated with proper connection between the main body (3) and the at least one fluid dispensing unit (4).

* * * * *